US010260176B2

(12) United States Patent
Himmelstoss et al.

(10) Patent No.: US 10,260,176 B2
(45) Date of Patent: Apr. 16, 2019

(54) HEDDLE FOR JACQUARD LOOM, METHOD OF MANUFACTURING THE HEDDLE, AND WEAVING LOOM INCLUDING SUCH A HEDDLE

(71) Applicant: STAUBLI LYON, Chassieu (FR)

(72) Inventors: Michael Himmelstoss, Luzinay (FR); Michel Herrmann, Fontaines sur Saone (FR)

(73) Assignee: STAUBLI LYON, Chassieu (FR)

( * ) Notice: Subject to any disclaimer, the term of this patent is extended or adjusted under 35 U.S.C. 154(b) by 93 days.

(21) Appl. No.: 15/647,644

(22) Filed: Jul. 12, 2017

(65) Prior Publication Data

US 2018/0023224 A1 Jan. 25, 2018

(30) Foreign Application Priority Data

Jul. 25, 2016 (FR) ..... 16 57121

(51) Int. Cl.
*D03C 9/02* (2006.01)
*D03C 3/30* (2006.01)
(Continued)

(52) U.S. Cl.
CPC ..... *D03C 9/024* (2013.01); *D03C 3/30* (2013.01); *D03C 3/38* (2013.01); *D03C 9/02* (2013.01);
(Continued)

(58) Field of Classification Search
CPC ..... D03C 9/02; D03C 9/024; D03C 9/026; D03C 9/0625; D03C 13/00
See application file for complete search history.

(56) References Cited

U.S. PATENT DOCUMENTS 4,355,665 A * 10/1982 Ramseier ..... D03C 9/028 139/96
5,819,809 A * 10/1998 Bassi ..... D03C 3/40 139/85
(Continued)

FOREIGN PATENT DOCUMENTS

EP 0915195 A1 5/1999
EP 3009543 A1 4/2016
(Continued)

OTHER PUBLICATIONS

French Search Report for FR 1657121, dated Apr. 12, 2017, 2 pages.

*Primary Examiner* — Robert H Muromoto, Jr.

(57) ABSTRACT

Heddle for a harness of a Jacquard weaving loom having two strands (32, 34) each equipped at a first end with a member for hooking-up the heddle to an element 10 of the harness, as well as a link (30) with an eyelet (36) for guiding a warp thread, this eyelet (36) being positioned, along a longitudinal axis (XI0) of the heddle, between both strands (32, 34). The link (30) is in a synthetic material and has two branches (52, 54) positioned on either side of the eyelet (36) along the longitudinal axis (XI0). A portion (522, 542) of each branch (52, 54) is over-molded on a second end (324, 344) of a strand (32, 34) opposite to its first end and shifted longitudinally from the eyelet (36). Further, each branch (52, 54) of the link completely surrounds the second end (324, 344) of the corresponding strand (32, 34). The second end of the strand (32, 34) is conformed with a geometry intended to achieve an anchoring which opposes the displacement of the overmolded portion of the branch of the link relatively to the second end of the strand along two opposite longitudinal directions (FI, F2), while the eyelet (36) is formed with the synthetic material which makes up the link (30).

20 Claims, 3 Drawing Sheets

Figure 1:
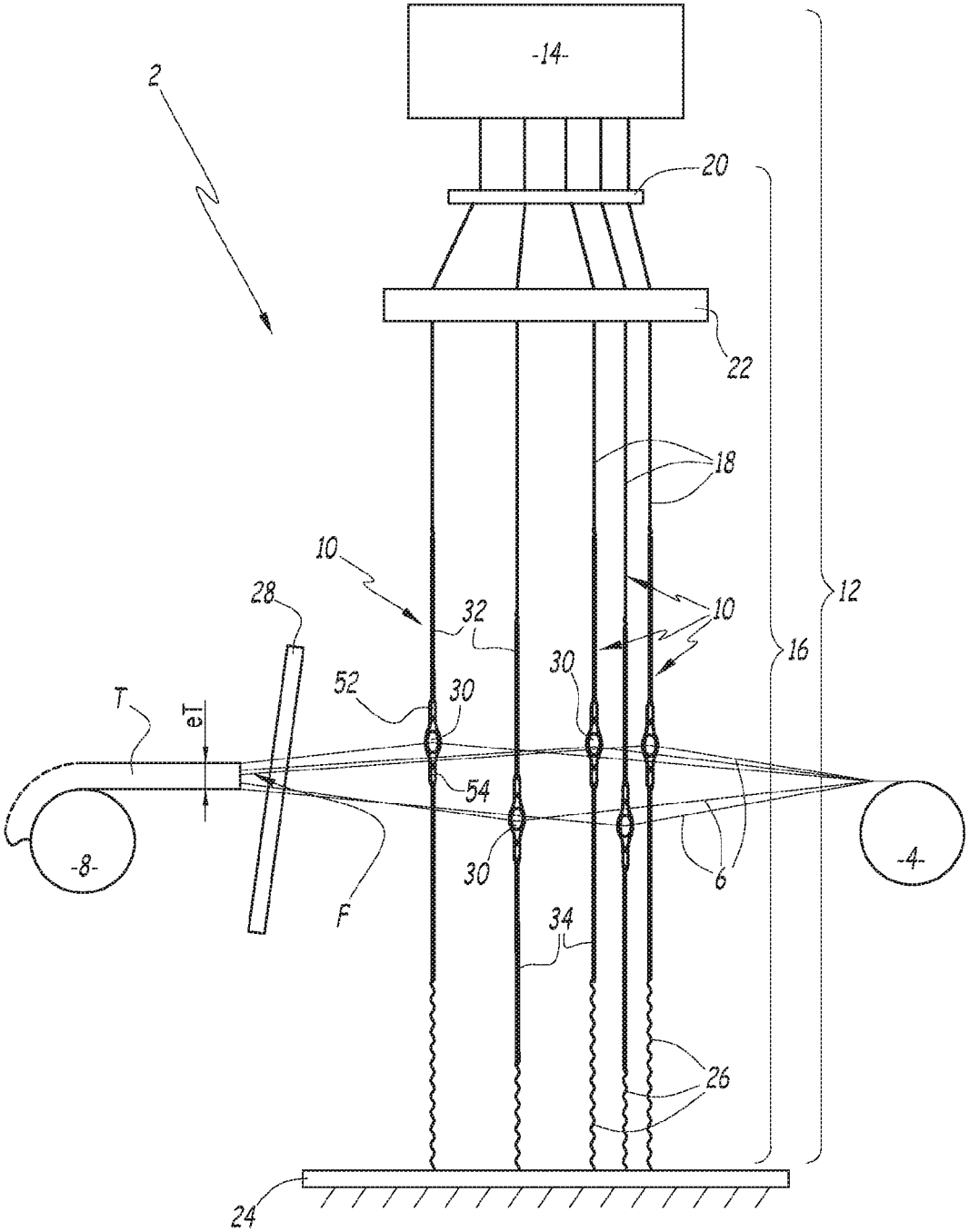

(51) Int. Cl.

| | |
|---|---|
| ***D03C 3/38*** | (2006.01) |
| ***D03C 9/06*** | (2006.01) |
| *D03C 9/00* | (2006.01) |
| *D03C 3/26* | (2006.01) |
| *D03C 3/32* | (2006.01) |

(52) U.S. Cl.
CPC ..... *D03C 9/026* (2013.01); *D03C 9/0658* (2013.01); *D03C 3/26* (2013.01); *D03C 3/32* (2013.01)

(56) References Cited

U.S. PATENT DOCUMENTS

| | | | | | |
|---|---|---|---|---|---|
| 6,014,989 | A * | 1/2000 | Tachon | D03C 3/40 | 139/88 |
| 6,883,553 | B2 * | 4/2005 | Bassi | D03C 9/02 | 139/93 |
| 7,398,799 | B2 * | 7/2008 | Gaubert | D03C 3/40 | 139/59 |
| 9,745,675 | B2 * | 8/2017 | Herrmann | D03C 3/40 | |
| 9,777,409 | B2 * | 10/2017 | Herrmann | D03C 9/02 | |
| 9,777,410 | B2 * | 10/2017 | Herrmann | D03C 9/02 | |
| 2007/0079887 | A1 * | 4/2007 | Korbutt | D03C 9/02 | 139/93 |
| 2016/0108561 | A1 * | 4/2016 | Herrmann | D03C 3/40 | 139/93 |
| 2016/0108562 | A1 * | 4/2016 | Herrmann | D03C 9/02 | 139/93 |
| 2016/0108563 | A1 * | 4/2016 | Herrmann | D03C 9/02 | 139/93 |

FOREIGN PATENT DOCUMENTS

| | | | |
|---|---|---|---|
| EP | 3009545 | A1 | 4/2016 |
| KR | 200478899 | Y1 | 12/2015 |

* cited by examiner 34
382
386
344
384
54
10
III
54
344
30a
52
36
324
30
32
322
38
40
X10
424
422
42
342
546
e36=e3
P30
Y10
X10
l360
D3
X10
e5
Y10
P30
32
l5

HEDDLE FOR JACQUARD LOOM, METHOD OF MANUFACTURING THE HEDDLE, AND WEAVING LOOM INCLUDING SUCH A HEDDLE

The invention relates to a heddle for a harness of a weaving loom of the Jacquard type.

In the field of forming the shed on the weaving looms of the Jacquard type, it is known how to use heddles for vertically displacing the warp threads of a loom. A heddle is conventionally equipped with an eyelet for guiding a warp thread, the material and the shape of this eyelet being selected in order not to damage the warp thread crossing this eyelet and to not be worn under the friction for advancing the warp thread.

For example, EP-A-1 767 676 teaches how to insert an eyelet in carbon steel in an aperture formed by a longitudinal body in stainless steel. In the area of this longitudinal body which defines a link within which is positioned the eyelet, interactions occur with the thread crossing the eyelet as well as with the neighboring warp threads crossing the eyelets of the neighboring heddles. Within a mechanism for forming the shed, handling the contacts of a thread crossing the eyelet of a heddle and of the neighboring threads should be handled both with the link and the body of the heddle, by limiting the risks of hooking-up which may damage or cut these threads. This imposes a strictly controlled surface condition for the eyelet and the longitudinal body, as well as a very accurate assembling. The price cost of the heddle is thereby increased. Further, phenomena of corrosion of the eyelet may be observed when the warp threads are humidified for reducing the friction during weaving with a strong density. The corrosion alters the surface condition of the eyelet which becomes aggressive for the warp threads.

These are the drawbacks, which the invention intends more particularly to find a remedy by proposing a novel heddle for a Jacquard weaving loom which may be manufactured in a rapid and economical way and wherein the risks of damaging the warp chain crossing the heddle and the neighboring warp threads are substantially reduced as compared with the state of the art.

For this purpose, the invention relates to a heddle for a harness of a Jacquard weaving loom, this heddle comprising two strands, each equipped with a first end of a member for hooking-up the heddle to an element of the harness, as well as a link with an eyelet for guiding a warp thread, the eyelet being positioned, along a longitudinal axis of the heddle, between the strands. According to the invention, the link is in a synthetic material and comprises two branches positioned on either side of the eyelet along the longitudinal direction of the heddle and a portion of each branch is over-molded on a second end of a strand opposite to its first end and shifted longitudinally from the eyelet. Further, each branch of the link completely surrounds the second end of the corresponding strand and the second end of each strand is conformed with a geometry intended to make an anchoring opposed to the displacement of the over-molded portion of the branch relatively to the second end of the corresponding strand along two opposite longitudinal directions, while the eyelet is delimited by the synthetic material which makes up the link.

By means of the invention, the over-molded link on the second ends of both strands and in synthetic material defines the contact surfaces with a warp thread crossing the heddle as well as with the neighboring warp threads. The geometry of the second ends of the strands ensures efficient immobilization, by anchoring, of the link on the strands. These warp threads are exclusively in contact with the synthetic material of the link, at the eyelet and in the vicinity of the branches of the link along a vertical direction, which ensures non-aggressive contacts with the warp threads, in the absence of any corrosion since the link is not metal. Further, the constitutive synthetic material of the link may be selected depending on the material of the warp threads, in order to guarantee good compatibility between the link and the warp threads, as well as friction of low intensity.

According to advantageous aspects but non-mandatory of the invention, such a heddle may incorporate one or several of the following characteristics taken according to any technically admissible combination:

Each strand is filiform with its second end conformed with at least one undulation extending laterally relatively to the longitudinal axis and perpendicularly to a central axis of the eyelet.

The thickness of the link, measured along a transverse direction parallel to a central axis of the eyelet, is variable along the longitudinal axis, the link having at its over-molded portion on the second end of a strand, a maximum thickness and at the eyelet, a minimum thickness, the ratio of the maximum thickness over the minimum thickness being greater than or equal to 1.2.

The thickness of each strand, measured along a transverse direction parallel to a central axis of the eyelet, is equal to 0.4 mm, the maximum thickness of the link is 1 mm and the minimum thickness of the link is 0.8 mm.

Each stand is a filiform element with a circular section and each branch of the link ends, opposite to the eyelet, with a frustoconical portion centered on the strand.

The maximum width of each branch, measured along a lateral direction perpendicular to the longitudinal axis and to a central axis of the eyelet is strictly less than the maximum width of the link, measured along the same lateral direction at the eyelet, the ratio of the width of each branch, measured at its over-molded portion on the second end of the corresponding strand, over the maximum width of the link at the eyelet being preferably less than or equal to 0.5.

The length of the over-molded portion of a branch of the link is less than or equal to half the length of this branch, these lengths being measured parallel to the longitudinal axis.

The length of each branch measured parallel to the longitudinal axis is greater than or equal to 10 mm.

The eyelet is of an oval shape, with truncated and rectilinear ends along the longitudinal axis, for which the width, measured along a lateral direction perpendicular to the longitudinal axis and to a central axis of the eyelet, is greater than or equal to 1.2 mm, preferably greater than or equal to 1.4 mm.

The synthetic material of the link is a polymer and the strands are in metal, preferably in stainless steel.

An extreme portion of each branch opposite to the eyelet and an adjacent portion of the corresponding strand are covered with a protective sleeve, preferably made in epoxide adhesive.

According to another aspect, the invention relates to a weaving loom including a mechanism for forming the shed which inter alia comprises a Jacquard machine, a harness and a set of heddles. According to the invention, at least one of these heddles is as mentioned above.

Advantageously, this weaving loom is configured for weaving a fabric with a thickness of greater than 5 mm and each branch of the link of the heddle has a length, measured parallel to its longitudinal axis, which is strictly greater than the thickness of the fabric. This loom gives the possibility of guaranteeing that, with an open shed, the portions of a heddle in contact with the warp threads crossing the heddles in the same position of opening of the shed are formed by its link which is made in a synthetic material and which does not risk damaging or cutting the neighboring threads.

Finally, the invention relates to a method for manufacturing a heddle as mentioned above, this method comprising at least steps consisting of:

a) conforming at least one end of each of both filiform elements intended to form the strands, with a geometry intended to achieve an anchoring
b) positioning both filiform elements in an injection mold with their conformed ends which face each other within an imprint of this mold
c) injecting an amount of synthetic material in the imprint, so as to make up the link with the eyelet, while completely surrounding each conformed end with the synthetic material.

By means of the method of the invention, the heddle may be manufactured by over-molding conformed ends of the strands, which guarantees efficient anchoring of the strands in the link, along two opposite longitudinal directions.

According to an advantageous aspect of the invention, during step c), the synthetic material is injected through two injection points located at a front face of the link, these injection points being preferably located each at a distinct branch of the link. This distribution of the injection points promotes the distribution of the synthetic material inside the injection mold, notably around non-rectilinear end sections of the strands.

Figures 2, 5, 6, 7, 8:
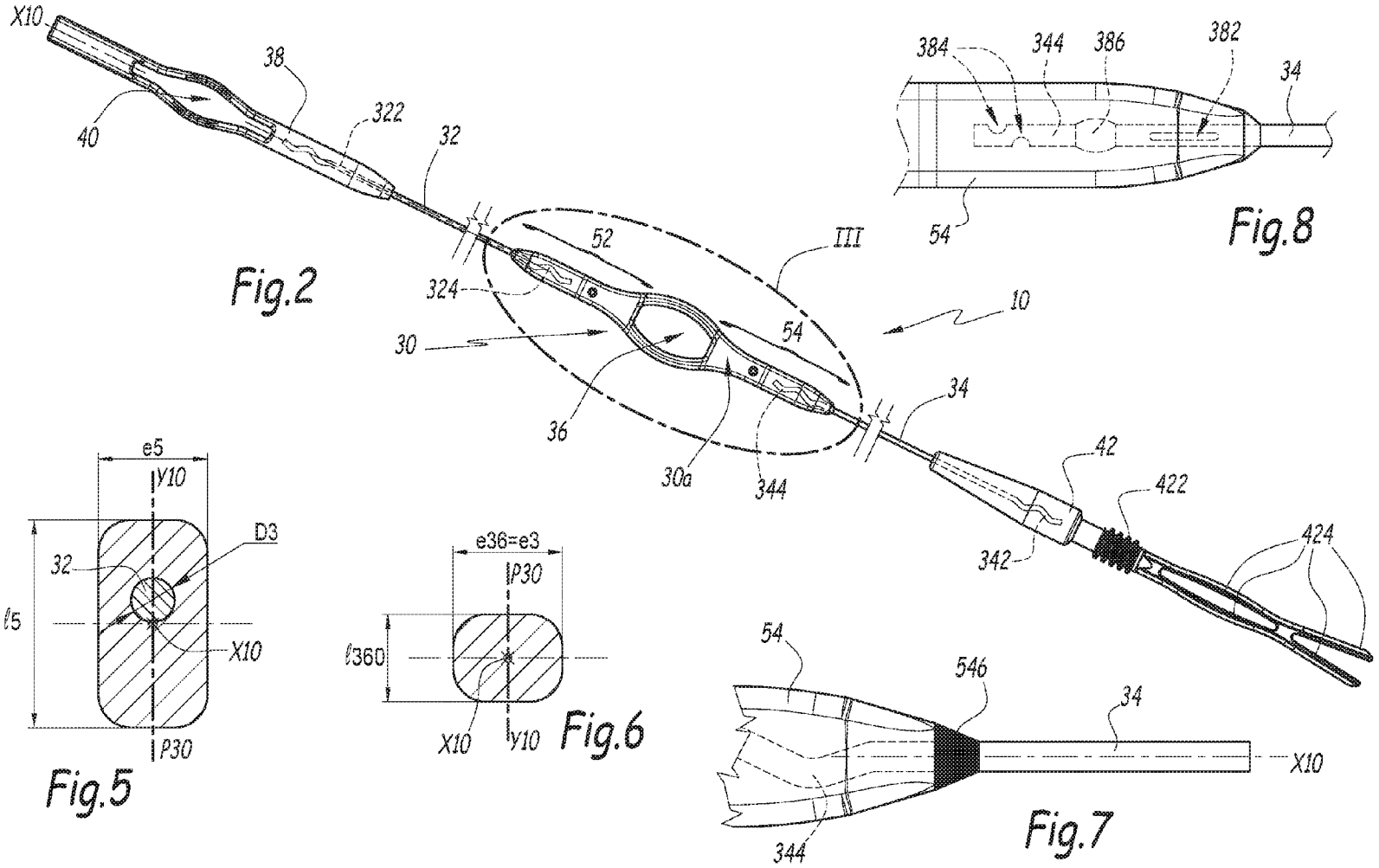
Figure 3:
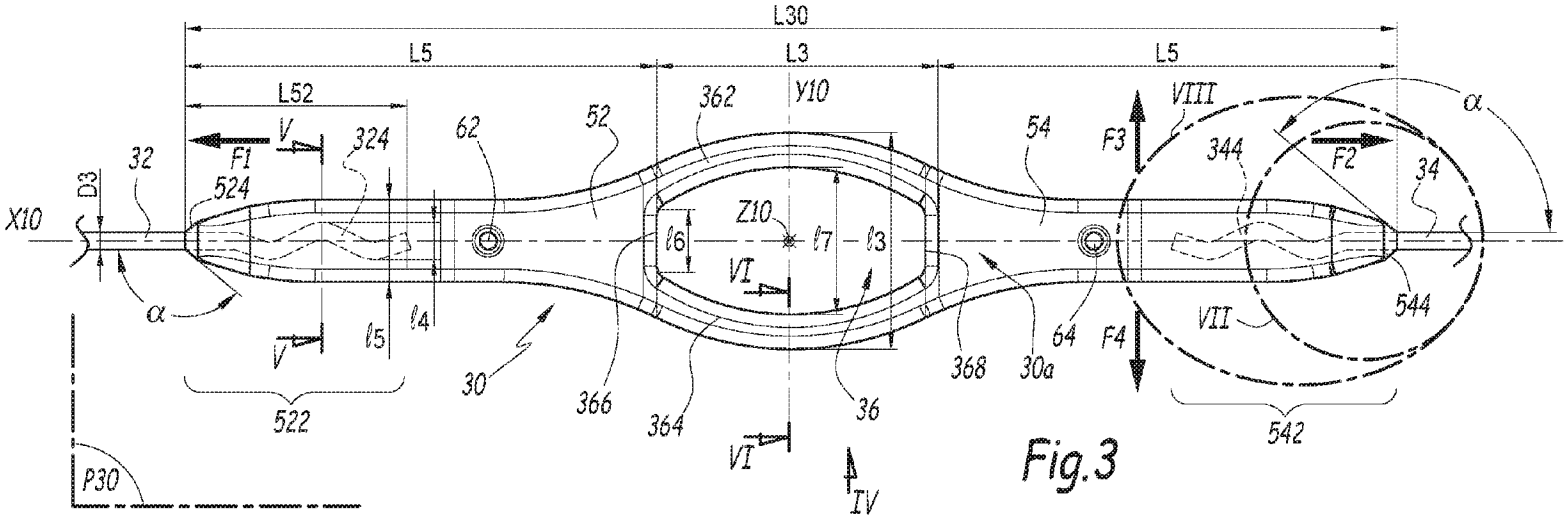
Figure 4:
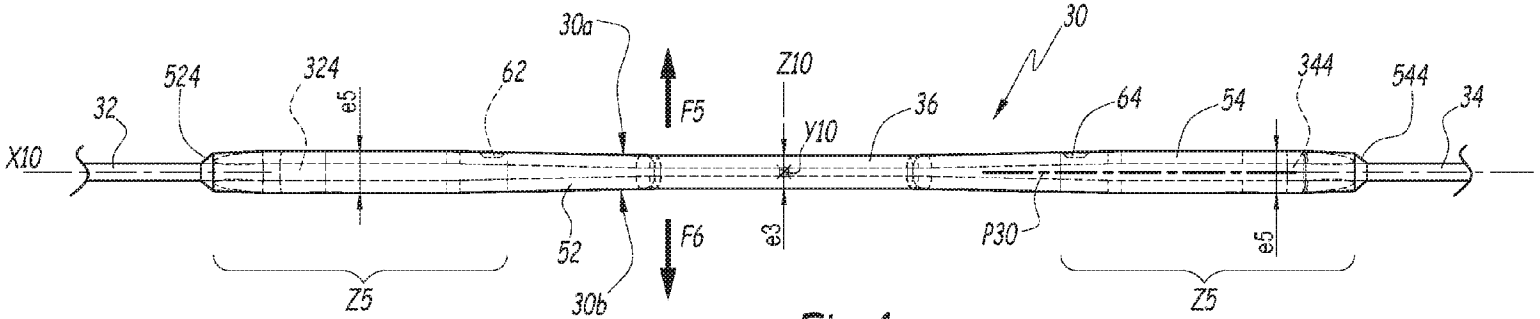

The invention will be better understood and other advantages thereof will become more clearly apparent in the light of the description which follows of two embodiments of a Jacquard weaving loom and of a heddle according to its principle, exclusively given as an example and made with reference to the appended drawings wherein FIG. 1 is a schematic illustration of the principle of a weaving loom according to the invention, in an open shed, FIG. 2 is a partial front view at a larger scale of a heddle of the weaving loom of FIG. 1 during manufacturing, FIG. 3 is a view at a larger scale of the detail III in FIG. 2, FIG. 4 is a side view in the direction of the arrow IV in FIG. 3, FIG. 5 is a sectional view at a larger scale along the line V-V in FIG. 3, FIG. 6 is a sectional view at a larger scale along the line VI-VI in FIG. 3, FIG. 7 is a view corresponding to the detail VII in FIG. 3, at the end of the manufacturing of the heddle, and FIG. 8 is a view corresponding to the detail VIII in FIG. 3, for a heddle according to a second embodiment of the invention.

The weaving loom 2 illustrated in FIG. 1 is configured for weaving a fabric T for which the thickness eT is greater than 5 mm, for example of the order of 10 mm.

The loom 2 comprises a beam 4 from which are unwound warp threads 6, as well as a take-up roll 8 intended to receive the fabric T.

A system, not shown and known per se, for inserting warp threads gives the possibility of letting the warp threads pass into a shed F defined between the warp threads 6.

Each warp thread passes through an eyelet of a heddle 10 for which the vertical position is controlled by a mechanism for forming the shed 12 which comprises a Jacquard mechanism 14 and a harness 16 formed by arcades 18 which cross a guidance plank 20, a comberboard 22 and return springs 26. Each heddle 10 is suspended to an arcade 18 and connected, in the lower portion, to a fixed frame 24 of the loom 2 by means of a return spring 26 which tends to draw this heddle downwards, against a raising action exerted by the corresponding arcade 18.

The loom 2 also comprises a comb 28 used for beating up the warp thread, newly inserted into the shed F, against the fabric T.

Each heddle 10 comprises a link 30, an upper strand 32 positioned above the link in the configuration of FIG. 1 and a lower strand 34 positioned below this link in this configuration.

Each strand 32 and 34 is formed by a metal wire, preferably in stainless steel, which has a length, measured parallel to a longitudinal axis X10 of the heddle, greater than or equal to 250 mm. The metal wire making up a strand 32 or 34 is in stainless steel, with a circular section of diameter D3 equal to 0.4 mm. In FIG. 3, the strands 32 and 34 are illustrated as interrupted, for the sake of clarity of the drawing.

A longitudinal direction of the heddle 10 is defined as a direction parallel to the axis X10.

The link 30 defines a closed internal contour 36 which forms an eyelet for the passage of a warp thread 6.

The central axis of the eyelet 36 is noted as Z10, i.e. an axis passing through the centre of the aperture which corresponds to this eyelet and forming an axis of symmetry of the edges delimiting this eyelet 36. The axis Z10 is a transverse axis for the heddle 10.

An axis perpendicular to the axes X10 and Z10 is noted as Y10. The axis Y10 is a lateral axis for the heddle 10.

The link 30 is of a flattened shape with its middle main plane P30 parallel to the axes X10 and Y10 and equidistant from both front faces 30*a* and 30*b* of the link.

The strand 32 comprises a first end 322 which is conformed by folding in a zigzag, with undulations which extend laterally, relatively to the axis X10, i.e. with a non-zero component parallel to the axis Y10 and perpendicularly to the central axis Z10 of the eyelet 36, while being deviated on either side of the axis X10. On this first end 322 an end-piece 38 in synthetic material is over-molded, which defines an aperture 40 for passage of an arcade 18 and for blocking this arcade by means of a sheath not shown, according to the technical teaching of EP-A-915 195.

The second end 324 of the strand 32, which is opposite to the first end 322, is also conformed by folding in a zigzag with undulations which extend laterally relatively to the axis X10, i.e. with a non-zero component parallel to the axis Y10, and perpendicularly to the central axis Z10 of the eyelet 36. These undulations are also positioned on either side of the axis X10. The undulations of the ends 322 and 324 extend in a same plane parallel to the axes X10 and Y10, which is favorable in terms of facility and rapidity of manufacturing.

A first end 342 of the strand 34 is conformed by folding in a zigzag, while a second end 344 of this same strand, opposite to the first end is also conformed by folding in a zigzag, the undulations of both of these ends extending laterally relatively to the axis X10, i.e. with a non-zero component parallel to the axis Y10, and perpendicularly to the central axis Z10 of the eyelet 36. They extend in a same parallel plane to the axes X10 and Y10.

In practice, the ends 322, 324, 342 and 344 are each at least one undulation. They therefore form non-rectilinear end sections for the strands 32 and 34.

Taking into account the scale of FIG. 2, the ends 322, 324, 342 and 344 are illustrated in thin lines, while they may be illustrated in dotted lines since they are embedded into the bulk of the link 30.

On the first end 342, an end-piece 42 is over-molded which corresponds to an external threading 422 on which a spring 26 may be screwed, as well as lamellas 424 against which rubs the spring.

As the second ends 324 and 344 are conformed with a folding in a zigzag, the transverse section of the strand is retained in each case, with a diameter D3 of 0.4 mm, which implies that the mechanical strength of a strand is not reduced by this shaping of its second end, while this may be the case if the material was removed.

According to the invention, the link 30, which extends between the strands 32 and 34 along the axis X10, is over-molded around the second ends 324 and 344 of these strands. Thus, the second ends 324 and 344 are positioned on a longitudinal level of the link 30. More specifically, the link 30 forms two longitudinal branches 52 and 54 respectively over-molded on the second ends 324 and 344 of the strands 32 and 34. The branches 52 and 54 form single blocks with the eyelet 36. The second ends 324 and 344 are shifted along the longitudinal axis X10 relatively to the eyelet 36, so that each second end 324, 344 only extends in the respective branch 52, 54.

By "over-molded", is meant that the link 30 is made by over-molding, i.e. any molding method wherein two or several materials are combined in a same imprint of a same mold in order to produce a part in a single piece. In particular, over-molding may consist of injecting and hardening, notably by cooling, a fluid material in an imprint of a mold in which is already positioned at least one portion of another component, in the solid state, in the example, the ends 324 and 344 of the strands 32 and 34. The injected material then hardens upon contact with the ends 324, 344 without any play between the injected material and the ends 324, 344.

Taking into account the zigzag conformation of the ends 324 and 344, the synthetic material fills the undulations of the zigzags and the link 30 is then anchored on each of these ends by being immobilized translationally along the axis X10 along two opposite directions, i.e. in the direction of the arrow F1 and in the direction of the arrow F2 in FIG. 3, on the ends 324, 344. In other words, the geometry of the ends 324 and 344 is intended to achieve an anchoring with the synthetic material of the branches 52 and 54, which induces a firm and permanent immobilization of the link 30 on the strands 32 and 34.

The longitudinal portion of the branch 52 is noted as 522 within which extends the second end 324 of the strand 32. This portion 522 is the portion of the branch 52 actually over-molded on the second end of the strand 32. This portion 522 is axially shifted, along the axis X10, with respect to the eyelet 36.

In the same way, the longitudinal portion of the branch 54 is noted as 542 within which extends the second end 344 of the strand 34, i.e. the portion of this actually over-molded branch around the end 344. This portion 542 is also shifted, axially along the axis X10, relatively to the eyelet 36.

In practice, in the example of the figures, the portions 522 and 542 of the branches 52 and 54 make up portions of these branches opposite to the eyelet 36.

The fact that the longitudinal portions 522 and 542 and the ends 324 and 344 are axially shifted relatively to the eyelet 36 gives the possibility of giving the portions 522 and 542 lateral and transverse dimensions, respectively parallel to the axes Y10 and Z10, sufficient for completely surrounding the ends 324 and 344, while giving the eyelet 36 an optimized shape for fulfilling its guiding function and a compact shape for not interfering with the neighboring warp threads of the heddle 10.

Except as regards the position of the undulations of the ends 324 and 344, the link 30 is symmetrical with respect to a first plane defined by the axes X10 and Y10, relatively to a second plane defined by the axes X10 and Z10 and relatively to a third plane defined by the axes Y10 and Z10.

The maximum thickness of the branch 52 measured parallel to the axis Z10 is noted as e5. This thickness e5 is measured at the portion 522. This thickness e5 is also the maximum thickness of the branch 54 measured at the portion 542. Moreover the minimum thickness of the eyelet 36 measured parallel to the axis Z10, in the plane Y10 Z10 is noted as e3.

The thickness e5 is equal to about 1 mm, while the thickness e3 is equal to about 0.8 mm. In other words, the link 30 is less thick at the eyelet 36 than at the portions 522 and 542 for anchoring the strands 32 and 34. This shape of the link 30 facilitates the passage of a warp thread inside the eyelet 36, while the passage of the neighboring warp threads around this link, because of the relatively small thickness e3 of the eyelet, while guaranteeing sufficient mechanical strength of the link at the areas for anchoring the strands.

In the example, the ratio e5/e3 is 1.25. In practice, satisfactory operation of the heddle 10 is observed when this ratio is greater than or equal to 1.2, it being specified that it is preferably less than or equal to 1.4.

The edges which define the link 30 are rounded over the whole external periphery of this link, except at the ends of the branches 52 and 54 opposite to the eyelet 36. These edges are also rounded over the whole internal periphery of the link 30 which defines the eyelet 36.

The end of the branch 52 opposite to the eyelet 36 is noted as 524. This end has a frustoconical shape with an aperture angle $\alpha$ relatively to the axis X10 for which the value is comprised between 125° and 150°, preferably of the order of 140°. The angle $\alpha$ is defined between the axis X10, in a portion of the strand 32 which is not covered by the branch 52 and a tangent to the outer surface of the end 524.

In the same way, the end 544 of the branch 54 opposite to the eyelet 36 is frustoconical and defines the same angle $\alpha$.

The axial length of the link 30, measured parallel to the axis X10 is noted as L30. This length L30 is in practice, comprised between 25 and 30 mm, preferably of the order of 28 mm.

The eyelet 36 into which passes the warp thread and which is centered on the axis Z10 is defined between two arms 362 and 364 of the link 30 which each extend between the branches 52 and 54, on either side of the plane X10 Z10. As visible in FIG. 6, the section of each arm 362 or 364, taken along the plane Y10 Z10, is square with rounded corners. In other words, the width l360 of an arm 362 or 634 measured parallel to the axis Y10 is equal to its thickness e36 measured parallel to the axis Z10. Taking into account the sectional plane of FIG. 6, the value of the thickness e36 visible in this figure is the minimum thickness of the link at the eyelet, therefore equal to the thickness e3. The arms 362 and 364 are in one piece with the branches 52 and 54, i.e. formed with the same over-molded synthetic material.

The maximum external width of the link 30 in the longitudinal area of the eyelet 36 is noted as l3, this width being measured parallel to the axis Y10. This width l3 is also the maximum width of the link 30 and has the value 5 mm in the example. The width of a branch 52 or 54 also measured parallel to the axis Y10 is noted as l5. l5 is variable along the longitudinal axis X1. Over the whole length of the branch 52 and over the whole length of the branch 54, except at the ends 524 and 544, the ratio l5 over e5 is strictly greater than 1. In other words, except at the ends 524 and 544, each branch 52 or 54 is wider than thick. As visible in FIG. 5, the section of a branch 52, 54 is flattened, except in the vicinity of the ends 524, 544. Further, the ratio of the maximum width l5 of the branch 52, 54 over l3 is strictly less than 1. In other words, the branches 52 and 54 are less wide than the link in the area of the eyelet 36 in the lateral direction. Practically, by considering the width l5 at an over-molded portion 522 or 542, which has the value 2 mm in the example, the ratio l5/l3 is preferably less than 0.5. In other words, at their over-molded portions 522 or 542, the branches 52 and 54 are at least twice less wide than the link 30 in the area of the eyelet 36.

Practically, as this emerges from the comparison of FIGS. 3 and 4, each branch 52 or 54 has a constant and maximum thickness e5 over an area Z5 which comprises the anchoring portion 522 or 542. By moving from the area Z5 to the eyelet 36, the thickness of the branch 52, 54 gradually decreases, while the width l5 gradually increases.

Except at the end 524, 544, the width l5 is strictly greater than the congestion in width l4 of the zigzag end 324, 344. This gives the possibility that the branch 52, 54 be positioned on either side of the end 324, 344 along a direction parallel to the axis Y10. Moreover, as the thickness e5 is greater than the diameter D3, each branch 52, 54 is also positioned on either side of the end 324, 344 along a direction parallel to the axis Z10. All around the longitudinal axis X10, the end 324, 344 is therefore completely embedded into the synthetic material which makes up the portion 522, 542 of the branch 52, 54. The branch 52, 54 therefore completely surrounds the end 324, 344, which guarantees efficient mechanical anchoring of this end within this branch, not only along the two longitudinal directions of the arrows F1 and F2 but also along two opposite lateral directions illustrated by the arrows F3 and F4 and along two opposite transverse directions represented by the arrows F5 and F6.

The geometry of the eyelet 36 is globally oval with two rectilinear areas or flats 366 and 368 parallel to the axis Y10 and respectively made at the bottom of the branches 52 and 54, i.e. in the area for connection between these branches and the eyelet 36. The width of the areas 366 and 368 is noted as l6 and the inner maximum width of the eyelet 36 is noted as l7. Moreover the internal length of the eyelet 36 is noted as L3. In practice, the width l6 is comprised between 1.1 and 1.7 mm, preferably of the order of 1.4 mm, the width l7 is comprised between 3.3 and 3.5 mm, preferably of the order of 3.4 mm, while the length L3 is comprised between 5.4 and 7 mm, preferably of the order of 6 mm.

The length of the branch 52 is noted as L5, between the end 524 and the flat area 366 positioned on the side of this branch, along the longitudinal axis X1. The length L5 is also the length of the branch 54, between the end 524 and the flat area 368, along the longitudinal axis X1. The length L5 is greater than the thickness of the fabric eT, i.e. greater than 10 mm, preferably equal to 11 mm. Thus, the ratio L5/L30 is comprised between 0.36 and 0.50, preferably of the order of 0.39.

Moreover the length of the over-molded portion 522 or 542 measured parallel to the axis X10 is noted as L52. This length L52 is less than or equal to half of the length L5. In other words, the strand 32, respectively 34, extends inside the branch 52, respectively 54, on less than half of the length of this branch. This gives the possibility of giving the branch 52 rigidity in the portion 522 where it is "armed" by the end 324 and an efficient flexibility between this portion 522 and the eyelet 36 where it is not "armed". In practice, the length L52 is of the order of 5 mm and the ratio L52/L5 is comprised between 0.45 and 0.5, while the ratio L52/L30 is comprised between 0.17 and 0.25.

A method for manufacturing the heddle of FIGS. 2 to 7 will now be described.

In a first step, the strands 32 and 34 are conformed each with a zigzag section intended to form their second end 324 or 344.

In the place of a zigzag section, another non-rectilinear section may be contemplated. Such a section is preferably made without removal of material on the strands 32 and 34, i.e. without reduction of the area of their cross-section, in order not to weaken these structural elements.

Next, both strands 32 and 34 are positioned in a mold with their zigzag sections in place within a same imprint of this mold and facing each other, in the configuration illustrated in FIG. 3.

Next, the mold is closed and a suitable amount of heated synthetic material is injected into the imprint of the mold at two distant injection points along the axis X10, each injection point opening into the imprint of the mold at a volume delimiting one of the branches 52 and 54, in the portion of this branch with constant width l5, outside the over-molded portion 522, 524. Both injection points are made at a surface of the mold forming the same front face 30*a* of the link 30. The traces of the injection points on the link 30 are visible in FIGS. 3 and 4, with the references 62 and 64, respectively on the branches 52 and 54. Both of these injection points 62 and 64 are symmetrical with respect to the plane Y10 Z10. The gasket plane delimited by the injection mold is formed at the middle plane P30.

The synthetic material used may be a polymer, either charged or not, for example a polyamide 6.6 loaded with molybdenum. The amount of injected material into the mold is sufficient for filling the imprint, so that the synthetic material will surround the ends 324 and 344 of the strands on every side, which ensures an efficient mechanical anchoring of these strands in the link 30 once the injection is completed and the synthetic material cools and forms the eyelet 36 around the imprint. Polyamide 6.6 has the advantage of being very fluid when it is heated to a sufficient temperature, which ensures a complete filling of the imprint of the mold during the injection. The molybdenum load improves slipping of the link 30 against the neighboring threads, when the heddle 10 is mounted within the mechanism for forming the shed 12.

After cooling of the synthetic material, the heddle is ejected by means of ejectors integrated to the mold, along a transverse direction, i.e. parallel to the axis Z10, by exerting a force on the front face 30*b* of the link opposite to the front face 30*a* onto which open the injection points.

The heddle is then in the configuration of FIGS. 3 to 6. The eyelet 36 is delimited by the synthetic material which forms the link 30. After the ejection of the link 10 from the imprint of the mold, a protective sleeve is affixed around the end 524 or 544 of each branch 52 or 54 and of a portion adjacent to the strand 32 or 34. This sleeve is preferably made in epoxide resin and affixed in the viscous condition all around each end 524 or 544. Once it has hardened, it forms a softened continuous transition area between the outer surface of a branch 52 or 54 and the outer surface of the adjacent strand 32 or 34, without any risk of hooking-up with a neighboring thread. Such a sleeve is visible in FIG.

7 with reference 546 an equivalent sleeve being affixed at the end of the branch 52 opposite to the eyelet 36.

In practice, the end-pieces 38 and 42 may also be over-molded on the first ends 322 and 342 of the strands 32 and 34, in specific injection imprints, during the same step as the over-molding of the link 30.

The over-molding of the link 30 on the second ends 324 and 344 of the strands 32 and 34 simplifies the manufacturing of the heddle and gives the possibility of obtaining a link in a single piece and totally made in synthetic material, which limits the risks of wear of the warp threads, i.e. the warp thread passing through the eyelet 36 and the neighboring warp threads. Further, the nature of the synthetic material used for the over-molding may be adapted to the nature of the threads provided for passing into the mechanism for forming the shed 12, in order to ensure good physicochemical compatibility between these materials. As the link 30 is not metal, the corrosion risks are avoided, therefore the risks of abrasion of the warp threads because of the modification of the surface condition of the link are also avoided.

Further, the invention gives the possibility of manufacturing heddles of different lengths by simply acting on the length of the strands 32 and 34, between their end 322 and 324, on the one hand 342 and 344, on the other hand, and retaining the same link 30 and the same end-pieces 38 and 42.

The over-molding on the second conformed ends of the strands, achieved at the branches 52 and 54, gives the possibility of obtaining an anchoring between the strands 32 and 34 and the link 30 by the generation of a mechanical abutment of the synthetic material of each branch against the corresponding strand end in both longitudinal directions represented by the arrows F1 and F2 parallel to the axis X10, as well as in both lateral directions represented by the arrows F3 and F4 parallel to the axis Y10 and in both transverse directions represented by the arrows F5 and F6 parallel with the axis Z10. These mechanical abutments oppose the displacement of each branch 52, 54 relatively to the second end of the corresponding strand 32, 34 respectively along both opposite longitudinal directions F1, F2, along both opposite lateral directions F3 and F4 and along both opposite transverse directions F5 and F6, as well as around the axis X10 since the zigzags only extend laterally. In particular, the conformation of the ends 324 and 344 in a zigzag with at least one undulation relatively to the longitudinal axis facilitates the anchoring of the strands in the synthetic material, while limiting the impact on the density of the heddles since, when the undulation direction is orthogonal to the transverse direction Z10, the maximum transverse dimension of the heddles, i.e. the thickness e5 of the branches 52 and 54 is not increased by the zigzag conformation of the strands. The use of strands with a circular section gives the possibility of obtaining a continuous rounded contact surface and without any irregularities over the whole of the length of these strands exposed to the outside of the link 30 and of the end-pieces 38 and 42.

The length L5 of the 52 and 54 branches and the fact that these branches have a reduced width l5 relatively to the outer width l3 of the link, while the ratio L52/L5 is less than or equal to 0.5, gives the link 30 a flexibility which allows reduction in the flexure forces between the portions 522 and 542 and the eyelet 36, therefore increasing the lifetime of the heddle 10. Further, the reduced width l5 of the branches 52 and 54 relatively to the outer width l3 of the eyelet leaves more space for the neighboring threads.

The relatively large length L5 of the branches 52 and 55 promotes a contact with the neighboring warp threads with these branches in an open shed, including when the neighboring threads have an origin vertically shifted relatively to the warp thread passing through a heddle 10, as this is illustrated in FIG. 1. Indeed, in the case of a fabric T for which the thickness eT is relatively large, the warp threads have their origin in the fabric of the points which may be shifted in height, which, in the example of FIG. 1 has the effect of shifting downwards the two warp threads 6 which pass through the heddles 10 illustrated in the high position on the right of FIG. 1, with respect to the eyelet of the heddle 10 illustrated in a high position on the left of this figure. The relatively large length L5 of the branches 52 and 54 allow that these two shifted threads, in the same high position for opening the shed than the heddle illustrated on the left, are in contact with the branch 54 of the eyelet 30 of the heddle illustrated on the left, although they have as an origin a point of the fabric T located below the point of origin of the warp thread 6 passing through the heddle illustrated on the left. In other words, the length L5 of the branches 52 and 54 promotes the contact of the warp threads 6 with the links 30 of the heddles of the mechanism for forming the shed 12, in a heddle aperture configuration, rather than a direct contact with the metal strands 32 and 34.

Moreover, the total length L30 of the link is compatible with molding without any burrs at the gasket plane. A larger length may actually generate burrs since the longer is molded part the more the risks of burrs at the gasket plane are significant.

The areas or flats 366 and 368 of the eyelet 36 allows the heddle to be oriented with its plane X10Y10 practically parallel with the direction of a warp thread 6 crossing the eyelet 36, which gives the possibility of optimizing the passage of this warp thread in the middle of the other warp threads. In particular, the width l6 is adapted to a warp thread of the ribbon type or with a relatively large diameter, notably greater than 1 mm.

On the other hand, the frustoconical nature of the ends 524 and 544 with an angle $\alpha$ identical over the whole circumference of the strand, ensures a homogeneous filling of the imprint of the mold over the circumference of the strand, which limits the risks of occurrence of over-molding burrs in this area. The angle $\alpha$ between 125° and 150°, preferably 140° also contributes to this function. This angle $\alpha$ moreover allows good adherence of the sleeve 546 in epoxide resin.

As illustrated in FIG. 8 for the second embodiment, instead of the arrangements as zigzags, the second end 344 of the strand 34 may be conformed with through-orifice(s) 382 in a direction perpendicular to the longitudinal axis X10, segments 384 on the external surface of the strand and/or localized crushing(s), the synthetic material of the link filling or surrounding these arrangements in order to be anchored on the second end of the strand during the over-molding of the link.

In every case, the undulations of the first embodiment and the arrangements 382, 384 and 386 of the second embodiment form protruding recessed/raised portions and/or hollow portions of the second end of the strand allowing the anchoring of the synthetic material of the branches 52 and 54 with the second end of the strand.

The invention is not limited to the described embodiments. Diverse improvements may be provided thereto. For example, the synthetic material used may be a polymer loaded with fibers, notably with carbon fibers or a synthetic material other than a polymer, notably a synthetic ceramic.

The sleeves 546 and equivalent are optional.

In the place of the metal strands 32 and 34, strands in synthetic material may be used, preferably with a circular section.

Instead of filiform strands with a constant section, either circular or not, flattened strands of variable width may be used. Advantageously, the thickness of the strand, measured parallel to the axis Z10, remains less than or equal to 0.4 mm.

The described heddle may be adapted to a fabric with a thickness up to 80 mm, in particular by adopting a length L5 up to 81 mm.

The contemplated embodiments and alternatives above may be combined together for generating novel embodiments of the invention.

The invention claimed is:

1. A heddle for a harness of a Jacquard weaving loom, this heddle comprising two strands each equipped at a first end with a member for hooking-up the heddle to an element of the harness, as well as a link with an eyelet for guiding a warp thread, the eyelet being positioned, along a longitudinal axis of the heddle, between both strands, characterized in that

- the link is in a synthetic material and comprises two branches positioned on either side of the eyelet along the longitudinal axis,
- a portion of each branch of the link is over-molded on a second end of a strand opposite to its first end, the second end being shifted longitudinally from the eyelet,
- each branch of the link completely surrounds the second end of the corresponding strand,
- the second end of each strand is conformed with a geometry intended to make an anchoring opposing the displacement of the over-molded portion of the branch of the link relatively to the second end of the corresponding strand along two opposite longitudinal directions,
- the eyelet is delimited by the synthetic material which makes up the link.

2. The heddle according to claim 1, wherein each strand is filiform with its second end conformed with at least one undulation extending laterally relatively to the longitudinal axis and perpendicularly to a central axis of the eyelet.

3. The heddle according to claim 1, wherein the thickness of the link, measured along a transverse direction parallel to a central axis of the eyelet, is variable along the longitudinal axis, the link having at its over-molded portion on the second end of a strand, a maximum thickness and, at the eyelet, a minimum thickness, the ratio of the maximum thickness over the minimum thickness being greater than or equal to 1.2.

4. The heddle according to claim 3, wherein the thickness of each strand, measured along a transverse direction parallel to a central axis of the eyelet, is equal to 0.4 mm, wherein the maximum thickness of the link is 1 mm and wherein the minimum thickness of the link is 0.8 mm.

5. The heddle according to claim 1, wherein each strand is a filiform element with a circular section and wherein each branch of the link ends, opposite to the eyelet, with a frustoconical portion centered on the strand.

6. The heddle according to claim 1, wherein the maximum width of each branch, measured according to a lateral direction perpendicular to the longitudinal axis and to a central axis of the eyelet, is strictly less than the maximum width of the link, measured along the same lateral direction at the eyelet.

7. The heddle according to claim 6, wherein the ratio of the width of each branch, measured at its over-molded portion on the second end of the corresponding strand, over the maximum width of the link at the eyelet are less than or equal to 0.5.

8. The heddle according to claim 1, wherein the length of the over-molded portion of a branch of the link is less than or equal to half the length of this branch, the lengths being measured parallel to the longitudinal axis.

9. The heddle according to claim 1, wherein the length of each branch measured parallel to the longitudinal axis is greater than or equal to 10 mm.

10. The heddle according to claim 1, wherein the eyelet is of an oval form, with truncated and rectilinear ends along the longitudinal axis, these rectilinear ends having a width, measured along a lateral direction perpendicular to the longitudinal axis and to a central axis of the eyelet, is greater than or equal to 1.2 mm.

11. The heddle according to claim 10, wherein the width of the rectilinear ends is greater than or equal to 1.4 mm.

12. The heddle according to claim 1, wherein the synthetic material of the link is a polymer and wherein the strands are in metal.

13. The heddle of claim 12, wherein the strands are in stainless steel.

14. The heddle according to claim 1, wherein an extreme portion of each branch opposite to the eyelet and an adjacent portion of the corresponding strand are covered with a protective sleeve.

15. The heddle of claim 14, wherein the protective sleeve is made in an epoxide adhesive.

16. A weaving loom including a mechanism for forming the shed comprising a Jacquard machine, a harness, and a set of heddles, wherein at least one of the heddles of the set of the heddles is according to claim 1.

17. The weaving loom according to claim 16 configured for weaving a fabric with a thickness greater than 5 mm, wherein each branch of the link of the heddle has a length, measured parallel to its longitudinal axis, strictly greater than the thickness of the fabric.

18. A method for manufacturing a heddle according to claim 1, wherein it comprises at least steps consisting of:

a) conforming at least one end of each of the two filiform elements intended to form the strands with a geometry intended to achieve an anchoring, b) positioning both filiform elements in an injection mold with their conformed ends which face each other within an imprint of the mold, c) injecting an amount of synthetic material into the imprint, so as to form the link with the eyelet, by completely surrounding each conformed end with the synthetic material.

19. The method according to claim 18, wherein during step c), the synthetic material is injected through two injection points located at a front face of the link.

20. The method of claim 19, wherein the injection points are each located at a branch distinct from the link.

* * * * *